US005317993A

United States Patent [19]

Payne

[11] Patent Number: 5,317,993

[45] Date of Patent: Jun. 7, 1994

[54] VERTICAL BUCKSTAY/LEVELER ATTACHMENT TO A HORIZONTAL BUCKSTAY

[75] Inventor: Ronald G. Payne, West Simsbury, Conn.

[73] Assignee: Combustion Engineering, Inc., Windsor, Conn.

[21] Appl. No.: 997,828

[22] Filed: Dec. 29, 1992

[51] Int. Cl.[5] ..... F22B 37/24

[52] U.S. Cl. ..... 122/510; 122/6 A

[58] Field of Search ..... 122/510, 511, 6 A; 29/890.03

[56] References Cited

U.S. PATENT DOCUMENTS 4,015,547 4/1977 Miller et al. ..... 122/510 X 4,499,860 2/1985 Loomis et al. ..... 122/510

*Primary Examiner*—Edward G. Favors

*Attorney, Agent, or Firm*—Robert S. Smith

[57] ABSTRACT

It has now been found that these and other objects of the invention may be attained in a vapor generation apparatus which includes a tube wall and an elongated first horizontal buckstay disposed at a first elevation. The apparatus also includes coupling means coupling the first horizontal buckstay to the tube wall, an elongated second horizontal buckstay disposed at an elevation that is higher than the first elevation. The apparatus also includes means for coupling the second horizontal buckstay to the tube wall. A first elongated vertical buckstay member has first and second ends and also includes for securing one end of the first elongated vertical buckstay members to one of the horizontal buckstay members. Second means for coupling the other end of the first elongated vertical buckstay member to the other horizontal buckstay, the means for coupling including a sleeve dimensioned and configured for receiving means extending from the other end of the first vertical buckstay member with sliding planar face to planar face engagement therebetween, the means for coupling allowing relative motion between the first vertical buckstay member the other horizontal buckstay member.

6 Claims, 3 Drawing Sheets

VERTICAL BUCKSTAY/LEVELER ATTACHMENT TO A HORIZONTAL BUCKSTAY

BACKGROUND OF THE INVENTION

The invention relates to boilers such as large utility boilers that are disposed in a frame that is provided to withstand the internal furnace gas pressure. As the furnace approaches operating temperature, the furnace walls expand vertically and horizontally. Additionally, the pressure excursions within the furnace, either an increase or a decrease in pressure within the furnace, cause a resultant additional flexing of the tube walls either inwardly or outwardly in a horizontal direction.

It has become customary and necessary to provide an arrangement of flanged girder beams, typically referred to as buckstays, that extend around the furnace to provide additional support to the furnace wall and prevent the dishing of the furnace walls in a horizontal direction because of pressure variations. More particularly, the arrangement typically uses both vertical and horizontal structural members that are respectively known as vertical and horizontal buckstays.

Typically, the horizontal buckstays are disposed in bands around the perimeter of the furnace tube walls at vertically spaced intervals (often between 15 and 40 feet) throughout the height of the furnace wall. Horizontally, the buckstays on opposite walls of the furnace are interconnected through buckstay ties so that the reaction of one buckstay is resisted by the reactions of the buckstay on the opposing wall so it can counteract the pressure forces acting on the furnace walls. It has been customary to provide vertical support members to interconnect adjacent buckstays with a connection that permits a sliding action that permits relative movement between the furnace tube wall with which a buckstay cooperates and the buckstays themselves. As the furnace expands in a vertical direction the effect on the various levels of buckstays will be different. This will be apparent because the elongation of the furnace tube walls will be different at different points in the furnace. This relative vertical expansion between the furnace tube wall structure and the buckstays will produce a very high localized bending moment on the buckstays. It has been customary to relieve bending moments with these vertical support members which extend between neighboring buckstays. Arrangements for relieving or preventing the bending movement of this type are disclosed in U.S. Pat. Nos. 3,461,847 and 3,861,360.

The invention also relates to an attachment to such buckstays that will cause the vertical buckstay to also act as a leveler. A leveler is a device that will provide lateral stability for the horizontal buckstay as well as maintaining its level position.

In such buckstay arrangements utilizing vertically extending support members for linking the vertically adjacent buckstays and absorbing the bending moment, the structural system is necessarily massive and also somewhat rigid. Therefore, the structural support system has a certain amount of inertia which must be overcome before the structural system can flex properly in response to pressure changes within the furnace and thereby absorb the pressure forces acting on the furnace walls. In the event there is a sudden change in furnace pressure, and explosive or implosive load may be exerted on the furnace tube walls over a very short period of time. In such a system as described above wherein the band of buckstays are interconnected in a vertical direction, it has been observed that the buckstay system may in some instance be incapable of responding to such a sudden change in furnace pressure without permanent damage to the buckstay system and/or the furnace wall.

The prior art apparatus that attaches the vertical buckstay to the horizontal buckstay is overly complicated. More particularly, one current design uses a pin in a slot of one of the in connections. Loading in a vertical buckstay that can be transmittal to the horizontal buckstay is small because of the line contact between the pin and the slot.

SUMMARY OF THE INVENTION

It is an object of the invention to provide lateral stability for a horizontal buckstay.

It is another object of the invention to provide a connection that transmits shear loading due to internal furnace gas pressure from the vertical buckstay to a horizontal buckstay.

It is another object of the invention to maintain the horizontal buckstay in a level position.

It has now been found that these and other objects of the invention may be attained in a vapor generation apparatus which includes a tube wall and an elongated first horizontal buckstay disposed at a first elevation. The apparatus also includes coupling means coupling the first horizontal buckstay to the tube wall and an elongated second horizontal buckstay disposed at an elevation that is higher than the first elevation. The apparatus also includes means for coupling the second horizontal buckstay to the tube wall. A first elongated vertical buckstay member has first and second ends and the apparatus includes means for securing one end of the first elongated vertical buckstay members to one of the horizontal buckstay members. The apparatus also includes means for coupling the other end of the first elongated vertical buckstay member to the other horizontal buckstay; the means for coupling including a sleeve dimensioned and configured for receiving means extending from the other end of the first vertical buckstay member with sliding planar face to planar face engagement therebetween. The means for coupling allowing relative motion between the first vertical buckstay member the other horizontal buckstay member.

The means extending from the first vertical buckstay member may be a first connecting channel. The first connecting channel may have a first generally planar face and opposed side flanges and the first generally planar face may be welded respectively to the vertical buckstay member and the second horizontal buckstay. In some embodiments of a invention the second connecting channel has a first generally planar face and opposed side flanges and the first generally planar face may be welded to the vertical buckstay member. The apparatus may include means for securing the one end of the elongated vertical buckstay member to one of the horizontal buckstay members and this means may include a first connecting channel welded respectively to the vertical buckstay member and the second horizontal buckstay. The apparatus may further includes a second and third vertical buckstay members for cooperation with respectively the first and second horizontal buckstay members.

BRIEF DESCRIPTION OF THE DRAWING

The invention will be better understood by reference to the accompanying drawing in which.

DESCRIPTION OF THE PREFERRED EMBODIMENT

Figure 1:
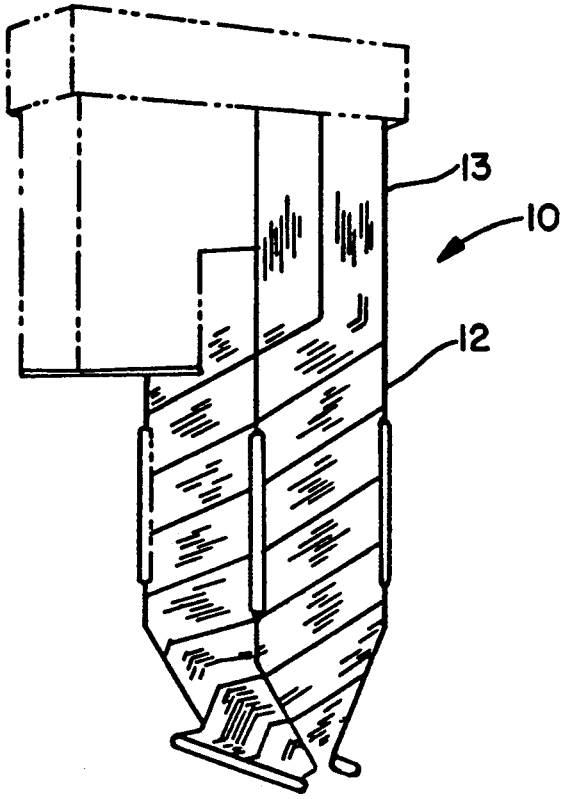
FIG. 1 is a general simplified view of a furnace having a spiral tube wall.

Referring now to FIG. 1 there is shown a furnace 10 that has a spiral tube wall 12. In the customary manner the upper portions have vertical tubes 13.

Figure 6:
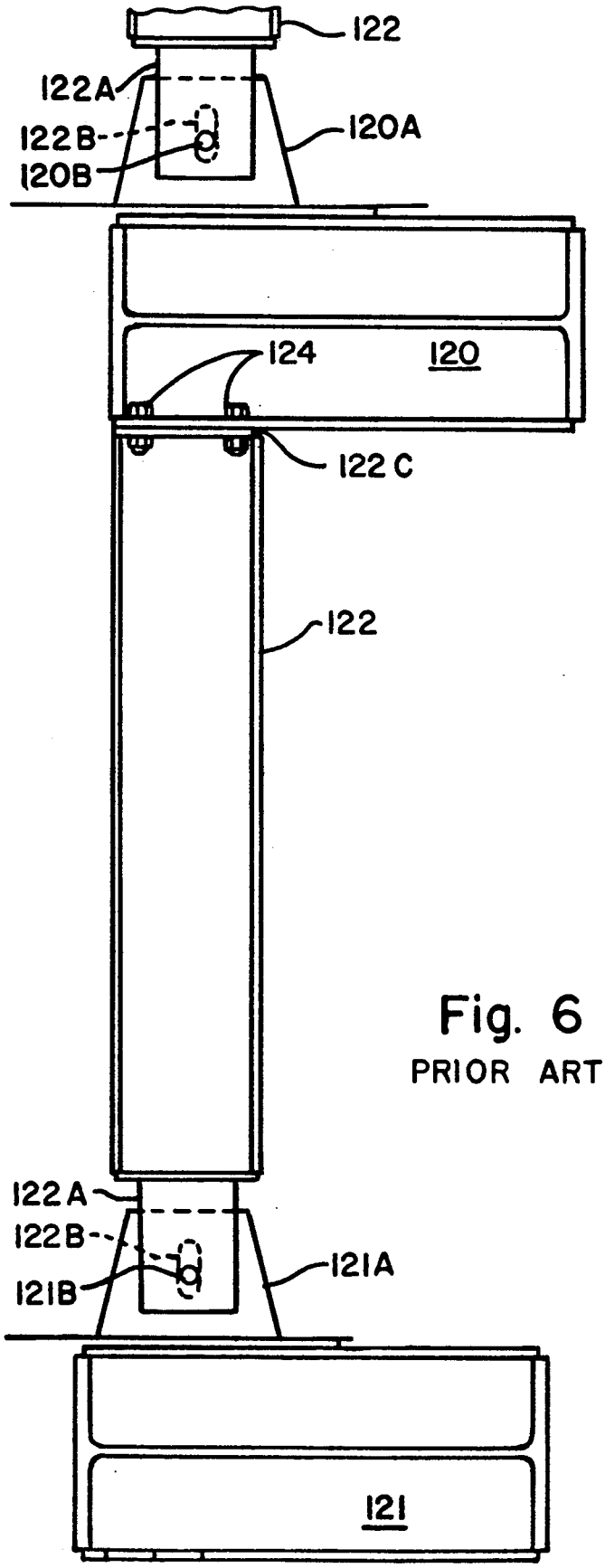
Fig. 6 PRIOR ART
FIG. 6 is an elevational view of a prior art apparatus coupling two horizontal buckstays.

Referring now to FIG. 6 there is shown the prior art apparatus that includes a first horizontal buckstay 120 and a second horizontal buckstay 121. They are interconnected by a prior art vertical buckstay member 122. More particularly, the prior art vertical buckstay member 122 has a flange 122C that is coupled to the first horizontal buckstay 120 by a plurality of bolts 124. The lower (as viewed) extremity of the prior art vertical buckstay member 122 is provided with a slot 122B that engages a pin 121B carried on a tongue 121A. The tongue 121A is fixed to the second horizontal buckstay 121. Similarly, a tongue 120A on the first horizontal buckstay 120 has a pin 120B fixed thereto. The pin 120B engages a slot 122B in a tongue 122A fixed to another prior art vertical buckstay member 122. It will thus be seen that the top ends of the prior art vertical buckstay members 122 are fixed to a first horizontal buckstay 120 and connected by a pin 121B and slot 122B at the lower extremity.

Figure 2:
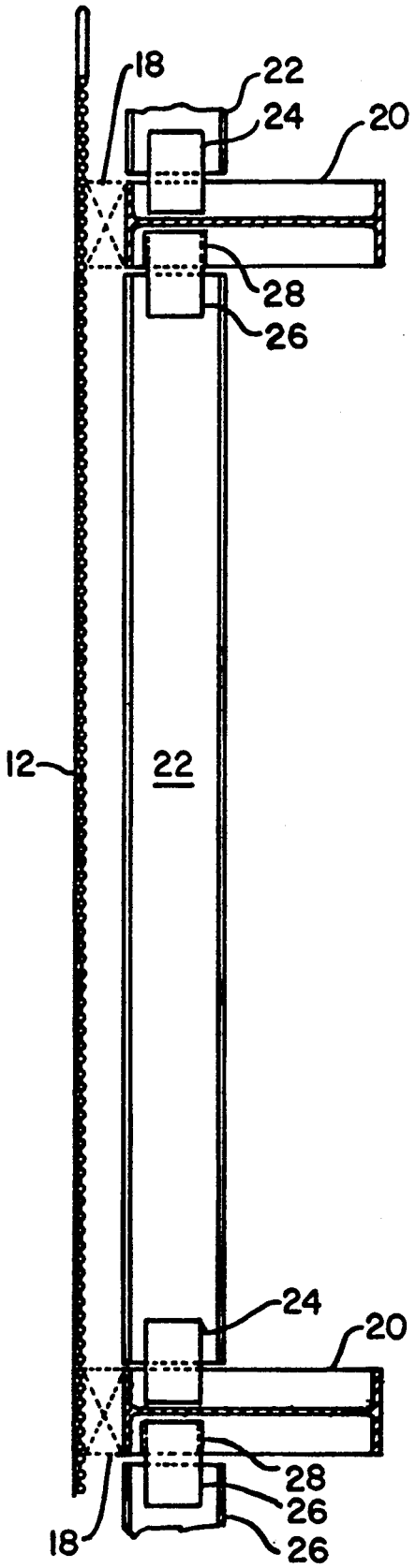
FIG. 2 is a sectional view taken along a vertical plane and illustrating a vertical buckstay and two horizontal buckstays cooperating in accordance with the present invention.

This prior art apparatus attaches the vertical buckstay to the horizontal buckstay is overly complicated. It will be understood that the assembly of first horizontal buckstay 120, second horizontal buckstay 121 and prior art vertical buckstay member 122 cooperates with a spiral tube wall 12 just as does the apparatus shown in FIG. 2. The left (as viewed) extremity of first horizontal buckstay 120 engages the spiral tube wall 12. Because the center of gravity of the first horizontal buckstay 120 is spaced from the spiral tube wall 12 there is a turning moment that is resisted by the prior art vertical buckstay member 122. In other words, if the first horizontal buckstay 120 droops downwardly the lower extremity of prior art vertical buckstay member 122 will tend to move to the left (as viewed). This is prevented by the slot 122B that engages the pin 121B that is fixed to the second horizontal buckstay 121.

A major disadvantage of this prior art structure is that the pin 121B must sustain both a pressure loading and a force to counteract the gravity loading described. This may result in flattening of the pin 121B and subsequent binding of the connection.

Referring now to FIGS. 2–5 the spiral tube wall 12 is formed by a plurality of axial sections of tubing 14 that are each connected by a fin 16. A connecting means or stirrup 18, that is conventional and not part of the present invention, couples respective horizontal buckstays 20 to the spiral tube wall 12.

In the preferred embodiment the upper and lower (as viewed) horizontal buckstays 20 cooperate with a vertical buckstay member 22. The vertical buckstay member 22 is elongated and has disposed at the axial extremity a second connecting channel 26. The second connecting channel 26 is welded to the upper axial extremity of a second vertical buckstay member 22 and meshes with a sleeve 28 that is welded to the upper horizontal buckstay 20. Disposed at the lower axial extremity of the vertical buckstay member 22 is a first connecting channel 24 that is welded to both the vertical buckstay member 22 and the lower horizontal buckstay 20.

Figure 4:
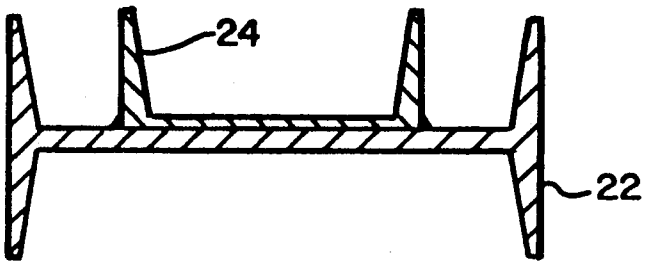
FIG. 4 is a sectional view taken along the line 4—4 of FIG. 3.
Figure 5:
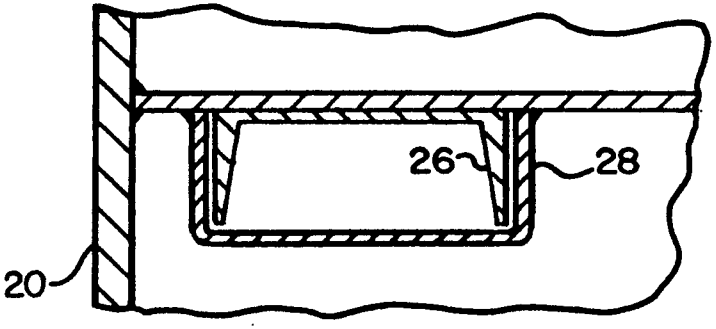
FIG. 5 is a sectional view taken along the line 5—5 of FIG. 3.
Figure 3:
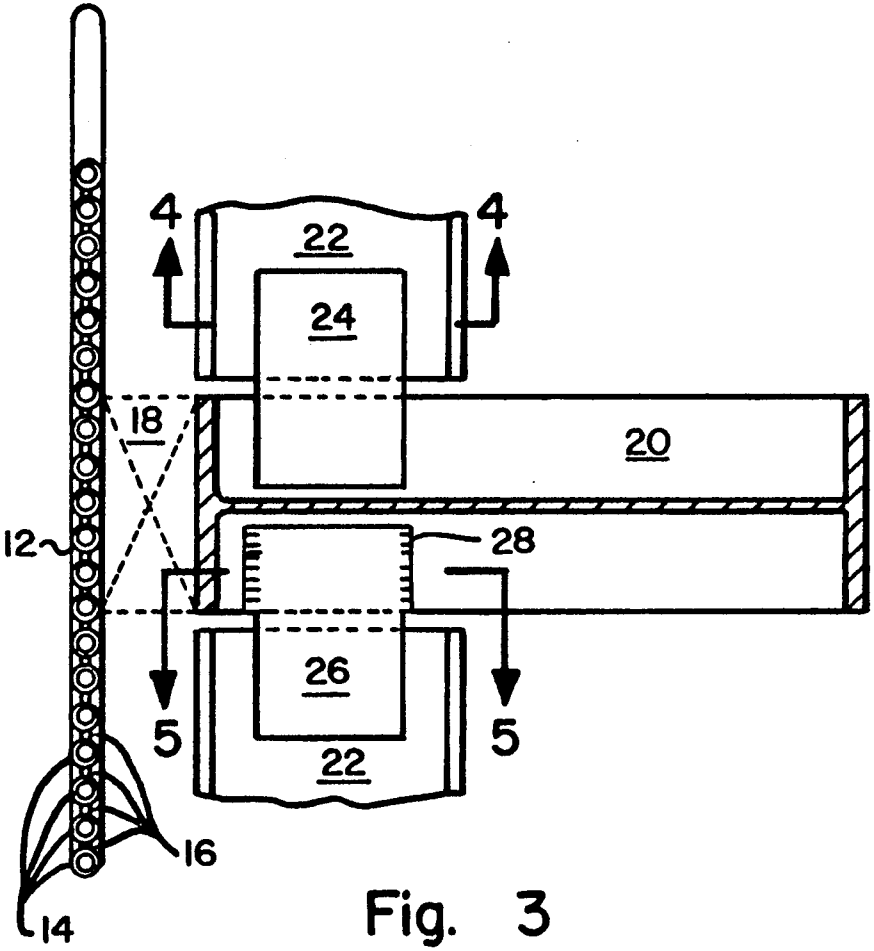
FIG. 3 is a view similar to FIG. 2 showing the same structure in greater detail.

As will be seen in FIGS. 3–5 the first connecting channel 24 is a generally U-shaped channel that has essentially a first side and two flanges. The first side is the face that is welded to the vertical buckstay member 22 and horizontal buckstay 20. Fixed to the lower part of the horizontal buckstay 20 is a sleeve 28 as best seen in FIG. 5. The sleeve 28 is dimensioned and configured for sliding engagement with the second connecting channel 26.

As in the prior art structure the lower horizontal buckstay 20 may tend to droop. because the first connecting channel 24 is welded to both the lower horizontal buckstay 20 and the vertical buckstay member 22 and because the cooperation between the second connecting channel 26 welded to the vertical buckstay member 22 and the sliding engagement of the second connecting channel 26 to the sleeve 28 there is a strong resistance to any drooping of the lower horizontal buckstay 20. In a similar manner there are similar means to prevent drooping of every other horizontal buckstay 20. More particularly, the sliding engagement between the sleeve 28 and the second connecting channel 26 allows movement of the spiral tube wall 12 such as that caused by thermal expansion of the axial sections of a tube 14. The sliding engagement between the second connecting channel 26 and the sleeve 28 will transmit a force from the lower horizontal buckstay 20 to the upper horizontal buckstay 20 and thus prevent any such droop.

This sliding action is required because the horizontal buckstays are attached to the spiral tube wall 12 by a connecting means connecting means or stirrup 18 and the hot furnace tube walls 12 are subject to thermal growth as the fluid inside becomes hotter. This is in contrast to the vertical buckstay 22 that is disposed between the horizontal buckstays 20, 20 that are at ambient temperature. Thus there is a different expansion taking place of the tube wall 12 and the vertical buckstay member 22.

The invention provides for field adjustability and simplified construction. In addition, a dual function of vertical buckstay as a structural member and as a leveler is particularly advantageous.

The invention allows for maximum shop fabrication and a minimum of field fabrication. Due to the field welding of the first connecting channel 24 to the lower horizontal buckstay 20 the maximum amount of field adjustability is allowed for fit-up errors. The term "fit-up errors" will be understood to refer to assembly problems as the result of dimensional problems in the individual parts being assembled. Also due to the field welding of a sleeve 28 to the web of the lower horizontal buckstay 20 there is a maximum amount of field adjustability to allow for fit-up errors.

The vertical buckstay member 22 acts as both a vertical structural member taking pressure loading from the furnace gas pressures and as a horizontal buckstay stabilizing device which allows the horizontal buckstay structural member to take a higher loading from the vertical buckstay member.

It will be understood by those skilled in the art that the invention has application to both spiral tube wall as well as vertical tube walls. Although the invention has been shown with the freedom of sliding motion is available at the upper axial extremity of the vertical buckstay member 22 that the sleeve 28 and the sliding cooperation with second connecting channel 26 could be disposed on the lower extremity of the vertical buckstay member 22. More particularly, the sliding connection may be at the all the upper axial extremities of all the vertical buckstay members 22 or at all the lower axial extremities of the vertical buckstay members 22.

It will further be seen that planar contact between the second connecting channel 26 and the sleeve 28 insure that wear will not be excessive and that a substantial force may be transmitted.

The invention has been described with reference to its illustrated preferred embodiment. Persons skilled in the art of such devices may upon exposure to the teachings herein, conceive othe variations. Such variations are deemed to be encompassed by the disclosure, the invention being delimited only by the following claims.

Having thus described my invention I claim:

1. A vapor generation apparatus which comprises:

a tube wall;

an elongated first horizontal buckstay disposed at a first elevation;

first means for coupling said first horizontal buckstay to said tube wall;

an elongated second horizontal buckstay disposed at an elevation that is higher than said first elevation;

second means for coupling said second horizontal buckstay to said tube wall;

a first elongated vertical buckstay member having first and second ends;

third means for securing one end of said first elongated vertical buckstay member to one of said horizontal buckstay members;

fourth means for coupling the other end of said first elongated vertical buckstay member to the other horizontal buckstay, said fourth means for coupling including a sleeve dimensioned and configured for receiving a fifth means extending from said other end of said first vertical buckstay member with sliding planar face to planar face engagement therebetween, said fourth means for coupling allowing relative motion between said first vertical buckstay member said other horizontal buckstay member.

2. The apparatus as described in claim 1 wherein;

said fifth means extending from said first vertical buckstay member is a first connecting channel.

3. The apparatus as described in claim 2 wherein:

said first connecting channel has a first generally planar face and opposed side flanges, said first generally planar face being welded respectively to said vertical buckstay member and said second horizontal buckstay.

4. The apparatus as described in claim 3 wherein:

said apparatus further includes a second connecting channel that has a first generally planar face and opposed side flanges, said first generally planar face welded respectively to said vertical buckstay member.

5. The apparatus as described in claim 4 wherein:

said third means for securing said one end of said first elongated vertical buckstay member to one of said horizontal buckstay members includes a second connecting channel welded respectively to said vertical buckstay member and said second horizontal buckstay.

6. The apparatus as described in claim 5 wherein:

said apparatus further includes second and third vertical buckstay members for cooperation with respectively said first and second horizontal buckstay members.

* * * * *